United States Patent [19]

Blakely et al.

[11] Patent Number: 4,762,173

[45] Date of Patent: Aug. 9, 1988

[54] HIGH EFFECTIVENESS CONTOUR MATCHING CONTACT HEAT EXCHANGER

[75] Inventors: Robert L. Blakely, Madison, Ala.; George J. Roebelen, Jr., Suffield; Arthur K. Davenport, E. Hartland, both of Conn.

[73] Assignee: The United States of America as represented by the Administrator of the National Aeronautics and Space Administration, Washington, D.C.

[21] Appl. No.: 943,346

[22] Filed: Dec. 19, 1986

[51] Int. Cl.[4] ..... F28F 3/14

[52] U.S. Cl. ..... 165/170; 165/81

[58] Field of Search ..... 165/166, 170, 81

[56] References Cited

U.S. PATENT DOCUMENTS

| | | | |
|---|---|---|---|
| 1,671,648 | 5/1928 | McCarthy | 165/170 |
| 3,181,605 | 5/1965 | Smith, Jr. | 165/170 X |
| 3,387,653 | 6/1968 | Coe | 165/170 X |
| 3,520,357 | 7/1970 | Bruner | 165/166 |
| 3,524,497 | 8/1970 | Chu et al. | 165/80 |
| 3,796,255 | 3/1974 | Streitz | 165/52 |
| 3,828,850 | 8/1974 | McMinn et al. | 165/109 |

FOREIGN PATENT DOCUMENTS

| | | | |
|---|---|---|---|
| 210774 | 3/1957 | Australia | 165/81 |
| 661278 | 9/1936 | Fed. Rep. of Germany | 165/170 |
| 3414395 | 10/1985 | Fed. Rep. of Germany | 165/166 |
| 1351495 | 12/1963 | France | 165/170 |

OTHER PUBLICATIONS

"Heat Transfer Experiments and Flow Visualization for Arrays of Short Pin Fins", D. E. Metzger and S. W. Haley, International Aerospace Abstracts, Technical Information Service, American Institute of Aeronautics and Astronautics, Inc., 4/1982.

*Primary Examiner*—Ira S. Lazarus
*Assistant Examiner*—Peggy A. Neils
*Attorney, Agent, or Firm*—Hardie R. Barr; John R. Manning; Edward K. Fein

[57] ABSTRACT

A high effectiveness contour matching contact heat exchanger (10) includes two opposing plates (12,13), each having alternating double rows (25) of attached pins (20). The ends (23) of the pins (20) opposite their respective plates (12,13) are received in tight-fitting holes (40) in the opposite plate (12,13), providing for flexibility of the heat exchanger (10) to maintain efficient thermal transfer contact between the plates (12,13) and the external thermal sources (50,51) of heat or cold, without causing gaps between the ends (23) of the pins (20) and their respective opposite plates (12,13) that decrease heat transfer effectiveness by adversely affecting flow distribution of the fluid flowing therepast.

10 Claims, 1 Drawing Sheet

FIG. 1
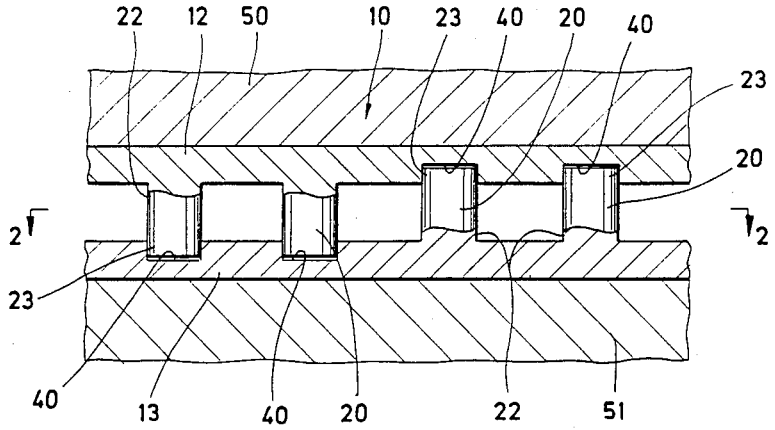
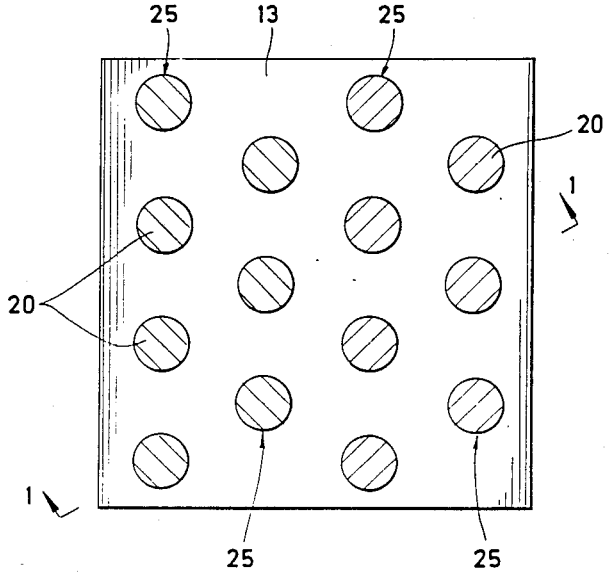
FIG. 2
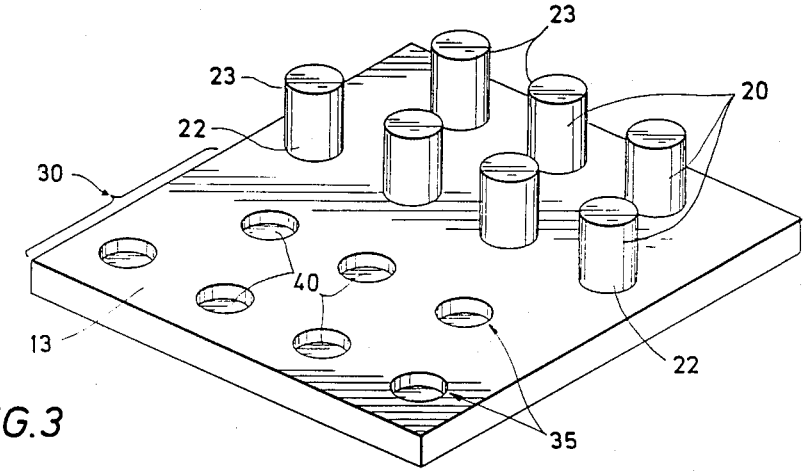
FIG. 3

HIGH EFFECTIVENESS CONTOUR MATCHING CONTACT HEAT EXCHANGER

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

BACKGROUND OF THE INVENTION

The present invention relates to heat exchangers, and more particularly to a new and improved high effectiveness contour matching contact heat exchanger having substantially greater manufacturing and physical distortion tolerances than prior devices.

In the design and manufacture of heat exchangers, it is desirable to maximize heat transfer efficiency while keeping fabrication costs to a minimum. Depending upon the intended application, other factors such as size and weight may also be critical. Examples of the latter include heat management needs ranging from outer space applications (such as in the Space Shuttle, or extra-vehicular space life-support/mobility units) to undersea heat transfer needs, etc. Objectives include high heat transfer effectiveness, low pressure drop, and uniform temperature and flow distributions perpendicular to the fluid flow direction. Additionally, the heat exchanger should have a flexible core design to provide a contour matching capability which will compensate for manufacturing, assembly, and operational tolerance and distortion build-ups that could occur variously on the core and/or the surface of the external heat (or cold) source, and to provide a uniform thermal contact conductance between the core and external heat (or cold) sources under all operating conditions. Such contact can be provided by operating the heat exchanger core at a pressure level slightly higher than ambient, thereby contouring the flexible core to provide such contact.

To improve heat transfer efficiency, prior art heat exchangers have from time to time employed pins or studs extending from the exchanger plates into the fluid flow path. Such pins substantially increase the surface area contact between the plate/pin structure and the fluid flowing therepast. In addition, they interdict the fluid flow, forcing the fluid into a tortuous, non-stratified flow pattern which further enhances the heat transfer efficiency.

When each plate of the heat exchanger is allowed to operate substantially independently of the other(s), the pins usually contact only their own respective plates. If the pins are simply pushed against the opposite plate, they must then each be fabricated (as by machining or grinding) to very precise lengths—and even then expansion and contraction of the plates, for whatever reason, will open gaps of varying thicknesses at the ends of the pins. Such gaps can then seriously upset the fluid and heat flow patterns.

If, on the other hand, the pins are rigidly attached to both plates, as by welding, then subsequent stresses caused by thermal expansion and contraction of the plates will too often break the welds or plates or pins, with obviously undesirable results.

As suggested, the prior art fails to teach a solution to this problem. For example, U.S. Pat. No. 3,524,497 (Chu et al., issued Aug. 18, 1970) discloses a heat exchange apparatus employing cooling studs on one plate and turbulator studs on an opposite plate. No provision is made, however, for eliminating the gap between one end of the pin and the adjacent plate. Heat transfer efficiency is helped, however, through the use of alternate rows of studs and pins.

U.S. Pat. No. 3,828,850 (McMinn et al., issued Aug. 13, 1974) is directed to a high temperature material introduction apparatus which cools by the circulation of a coolant therein. Opposing walls are provided with alternating baffle plates to force the coolant to follow a tortuous path from one end of the apparatus to the other.

U.S. Pat. No. 3,796,255 (Streitz, issued Mar. 12, 1974) again utilizes alternating baffles on opposite plates to force the air flowing therethrough to follow a tortuous path.

A need thus remains for a strong, light weight, inexpensive, uncomplicated, versatile, and reliable heat exchanger having high heat transfer effectiveness, low pressure drop, uniform temperature and flow distributions, and particularly having a flexible core design which provides contour matching capabilities, which compensates for manufacturing, assembly, and operational tolerance and distortion build-ups, and which accordingly furnishes an essentially uniform thermal contact conductance between the core and external heat (or cold) sources under essentially all operating conditions.

SUMMARY OF THE INVENTION

Briefly, the present invention meets the above needs and purposes with a new and improved high effectiveness contour matching contact heat exchanger having substantially greater manufacturing and physical distortion tolerances than prior devices. The core of the heat exchanger comprises a top plate and bottom plate, each having alternating single or multiple rows of pins attached thereto. Each of these pins fits into corresponding tight-fitting recesses in the opposite plate. Thus, the pin and recess design allows the heat exchanger core to expand and contract to match the mating part contours without significantly affecting the flow distribution, since gaps of varying thickness are not created at the ends of the pins by the expansion and contraction of the plates. Otherwise, as discussed above, in some prior art devices if a pin is attached to one plate and the pins are shorter than the distance between the plates, a gap is formed between one end of the pin and the other plate, causing maldistribution of the flow of the coolant. Alternatively, rigidly attaching the pins to both plates risks breaking the welds, pins, or plates under stress, and eliminates the contour matching feature.

In a preferred embodiment, the invention includes identical opposing shell members, preferably in the form of substantially flat plates. A plurality of heat transfer pins extends between the plate members. Each of the pins has a base and an outer end opposite the base. Each of the pins is then attached, at its respective base, to one of the plate members. Preferably, the pins are attached in staggered rows to form a tortuous path for fluids flowing therepast, thereby improving the heat transfer efficiency.

Each of the plates also includes close fitting receptacle holes located and sized for receiving pins mounted on the opposing plate. The holes receive the end portion of each pin at the outer end opposite its base and closely contact the sides of each pin near that end for good heat transferring engagement. At the same time, since the engagement is not rigid, it provides for relative movement between each pin and its corresponding hole.

It is therefore an object of the present invention to provide a new and improved high effectiveness contour matching contact heat exchanger and method therefore; such a heat exchanger and method having substantial manufacturing and physical distortion tolerance; which include opposing shell members having a plurality of heat transfer pins extending therebetween; in which each pin has a base and an outer end opposite the base, and each of the pins is attached at its respective base to a predetermined one of the shell members; in which there is a close fitting receptacle in the opposing shell member for receiving the portion of each pin at the outer end thereof and closely contacting the sides of each pin thereat while providing for relative movement between each pin and its corresponding receptacle, thereby allowing variations in the inter-shell spacing by as much as the depth of the receptacles without affecting flow distribution; and to accomplish the above objects and purposes in an inexpensive, uncomplicated, durable, versatile, and reliable method and apparatus, inexpensive to manufacture, and readily suited to the widest possible utilization in heat exchanger applications.

These and other objects and advantages of the invention will be apparent from the following description, the accompanying drawings, and the appended claims.

BRIEF DESCRIPTION OF THE DRAWINGS

FIG. 1 is a somewhat figurative, fragmentary, cross-sectional illustration, taken on line 1—1 in FIG. 2, showing the heat exchanger core according to the present invention;

FIG. 2 is another fragmentary cross-sectional illustration, taken on line 2—2 in FIG. 1, showing the staggered pin arrangement above the lower plate; and FIG. 3 is a perspective view of one of the heat exchanger plates.

DESCRIPTION OF THE PREFERRED EMBODIMENT

With reference to the drawings, the new and improved high effectiveness contour matching contact heat exchanger, and the method for the implementation thereof according to the present invention, will now be described. The drawing Figures show a fragmentary portion of such a heat exchanger, it being understood that in actual extent a typical heat exchanger according to the present invention would extend over a much greater proportional area, and would have many more pins than shown herein. The exact dimensions, of course, will be a matter of design choice according to the particular application at hand.

The heat exchanger 10 has opposing shell members 12 and 13, which in the preferred embodiment are in the form of identical flat plates. Secured in each plate, in staggered rows 25 (FIG. 2), are heat transfer pins 20. The pins are attached at their bases 22 to their respective plates 12 or 13. The end portions 23 of the pins 20, opposite their respective bases 22, then extend away from the plates toward the facing or opposing plate. The pin pattern (e.g., an equilateral triangular pattern) is such that the plates 12 and 13, when facing or opposed to one another, are complementary and provide a matching, uniform pin pattern, as can be seen in FIGS. 1 and 2. This can be easily done, for example by grouping the pins 20 in pairs of rows 25 and corresponding gaps 30 of like width, as shown in FIG. 3.

In the gaps 30 are rows 35 of receptacle holes 40. The holes 40 are sized to receive the end portions 23 of the pins 20 in close fitting, contacting relation for efficiently transferring heat between the pins 20 and both the plates 12 and 13. Since the pins extend into the holes, the inter-plate spacing may vary by as much as the depth of the holes 40 without losing contact between the pin end portions 23 and the holes 40 in which they are received. This protects the tortuous fluid flow pattern from being disrupted by gaps opening between pin ends and the plates when the plates move slightly toward or away from one another due to physical or thermal stress. Also, by leaving the pins free to accommodate these plate distortions, the invention protects from the development of further unnecessary stresses in the plates and/or pins. Further, manufacturing tolerances are obviously greatly increased, with consequent reductions in manufacturing costs.

As may be seen, therefore, the present invention has numerous advantages. It provides a strong, light weight, inexpensive, uncomplicated, versatile, and reliable heat exchanger having high heat transfer effectiveness, low pressure drop, and uniform temperature and flow distributions. The flexible core design of this invention provides contour matching capabilities which compensate for manufacturing, assembly, and operational tolerance and distortion build-ups, and which accordingly furnish an essentially uniform thermal contact conductance between the core and external heat (or cold) sources 50 and 51 under essentially all operating conditions.

While the methods and forms of apparatus herein described constitute preferred embodiments of this invention, it is to be understood that the invention is not limited to these precise methods and forms of apparatus, and that changes may be made therein without departing from the scope of the invention.

What is claimed is:

1. A high effectiveness contour matching contact heat exchanger having substantial manufacturing and physical distortion tolerance, comprising:

(a) opposing shell members, (b) a plurality of heat transfer pins extending between said shell members, each said pin having a base and an outer end opposite said base, and each of said pins being attached at its respective base to a predetermined one of said shell members, and (c) means forming a close fitting receptacle for receiving the portion of each said pin at said outer end thereof in the opposing said shell member and closely contacting the sides of each said pin thereat while providing for relative movement between each said pin and its corresponding receptacle, for efficiently transfering heat between said pins and said shell members notwithstanding variations in the inter-shell spacing as much as substantially the depth of said receptacles.

2. The heat exchanger of claim 1 wherein said shells are identical, each having an equal number of pins and receptacles arranged in a predetermined pattern to form pin-receptacle pairs when said identical shells are positioned face to face with one another.

3. The heat exchanger of claim 1 wherein said pins are arranged in staggered rows to form a tortuous path for fluids flowing therepast.

4. The heat exchanger of claim 1 wherein said means forming a close fitting receptacle for receiving the end portion of each said pin in the opposing said shell member further comprises means forming holes in the respective said shell member.

5. A high effectiveness contour matching contact heat exchanger having substantial manufacturing and physical distortion tolerance, comprising:

(a) opposing plate members, (b) a plurality of heat transfer pins extending between said plate members, each said pin having a base and an outer end opposite said base, each of said pins being attached at its respective base to a predetermined one of said plate members, and said pins being arranged in staggered rows to form a tortuous path for fluids flowing therepast, (c) means forming close fitting receptacle holes in the respective said plate member for receiving the portion of each said pin at said outer end thereof in the opposing said plate member and closely contacting the sides of each said pin thereat while providing for relative movement between each said pin and its corresponding hole, for efficiently transfering heat between said pins and said plate members notwithstanding variations in the inter-plate spacing as much as substantially the depth of said holes, and (d) said plates each having an equal number of pins and holes arranged in a predetermined pattern to form pin-hole pairs when said identical plates are positioned face to face with one another.

6. A distortion tolerant method for transferring heat between opposing shell members of a fluid-conducting heat exchanger and external thermal sources of heat or cold, comprising:

(a) thermally coupling the shell members to such thermal sources by pressuring the shell core with a fluid pressure greater than ambient pressure to establish intimate thermal contact between the shell members and the thermal source in response to the flexibility of the shell members, the shell members having a plurality of heat transfer pins extending therebetween, each of the pins having a base and an outer end opposite the base, and each of the pins being attached at its respective base to a predetermined one of the shell members, and (b) receiving the portion of each pin at the outer end thereof in a receptacle in the opposing shell member and providing for relative movement between each pin and its corresponding receptacle, for efficiently transfering heat between the pins and shell members and the external thermal source notwithstanding variations in the inter-shell spacing as much as substantially the depth of the receptacles, and maintaining the effectiveness of heat transfer from the fluid flowing therepast.

7. The method of claim 6 wherein the shells are identical, each having an equal number of pins and receptacles arranged in a predetermined pattern to form pin-receptacle pairs when the identical shells are positioned face to face with one another.

8. The heat exchanger of claim 6 wherein the pins are arranged in staggered rows to form a tortuous path for fluids flowing therepast.

9. The method of claim 6 wherein the close fitting receptacles for receiving the end portions of the pins in the opposing shell member are holes in the respective shell member.

10. A distortion tolerant method for transferring heat between opposing shell members of a fluid-conducting heat exchanger and external thermal sources of heat or cold, comprising:

(a) thermally coupling the shell members to such thermal sources by pressuring the shell core with a fluid pressure greater than ambient pressure to establish intimate thermal contact between the shell members and the thermal source in response to the flexibility of the shell members, the shell members having a plurality of heat transfer pins extending therebetween, each of the pins having a base and an outer end opposite the base, each of the pins being attached at its respective base to a predetermined one of the shell members, and the pins being arranged in staggered rows to form a tortuous path for fluids flowing therepast, and (b) receiving the portion of each pin at the outer end thereof in a close fitting receptacle hole in the opposing plate member and closely contacting the sides of each pin thereat while providing for relative movement between each pin and its corresponding hole, the plates each having the pins and holes arranged in a predetermined pattern to form pin-hole pairs when the opposing plates are positioned face to face with one another, for efficiently transfering heat between the pins and plate members and the external thermal source notwithstanding variations in the inter-plate spacing as much as substantially the depth of the holes, and maintaining the effectiveness of heat transfer from the fluid flowing therepast.

* * * * *